US006486442B2

(12) United States Patent
Wheeler

(10) Patent No.: US 6,486,442 B2
(45) Date of Patent: Nov. 26, 2002

(54) HEATING DEVICE WITH ELECTRIC HEATING ELEMENT AND THERMOCOUPLE

(75) Inventor: Jeffrey V. Wheeler, Battle Creek, MI (US)

(73) Assignee: Hotset Corporation, Battle Creek, MI (US)

( * ) Notice: Subject to any disclaimer, the term of this patent is extended or adjusted under 35 U.S.C. 154(b) by 0 days.

(21) Appl. No.: 09/970,733

(22) Filed: Oct. 4, 2001

(65) Prior Publication Data

US 2002/0047002 A1 Apr. 25, 2002

Related U.S. Application Data

(63) Continuation-in-part of application No. 09/689,405, filed on Oct. 12, 2000.

(51) Int. Cl.[7] ..... H05B 3/00
(52) U.S. Cl. ..... 219/243; 219/544
(58) Field of Search ..... 219/243, 544, 219/549–548; 338/238–243, 267, 270

(56) References Cited

U.S. PATENT DOCUMENTS

| | | | | | |
|---|---|---|---|---|---|
| 2,122,368 | A | * | 6/1938 | Engler | 83/171 |
| 2,192,655 | A | * | 3/1940 | Smith | 219/544 |
| 3,075,573 | A | * | 1/1963 | Piazze | 156/513 |
| 3,136,878 | A | | 6/1964 | Staller | 219/239 |
| 3,427,140 | A | | 2/1969 | Rhys et al. | 29/199 |
| 3,503,097 | A | * | 3/1970 | Krupp | 156/513 |
| 3,555,950 | A | | 1/1971 | Gijsbers et al. | 83/171 |
| 3,654,427 | A | | 4/1972 | Schoenwald | 219/241 |
| 3,786,228 | A | | 1/1974 | Castellana et al. | 219/233 |
| 3,786,229 | A | | 1/1974 | Hombrecher | 219/241 |
| 3,876,858 | A | | 4/1975 | Davis et al. | 219/243 |
| 3,881,163 | A | * | 4/1975 | Lindroth et al. | 219/541 |
| 3,890,485 | A | * | 6/1975 | Kozbelt | 219/544 |
| 3,920,963 | A | * | 11/1975 | Beasley et al. | 219/544 |
| 4,449,434 | A | * | 5/1984 | Johnson | 83/98 |
| 4,617,455 | A | * | 10/1986 | Schwarzkopf | 219/523 |
| 4,687,903 | A | | 8/1987 | Zimmerman | 219/241 |
| 4,974,768 | A | | 12/1990 | Ebata | 228/54 |
| 5,140,133 | A | | 8/1992 | O'Brien et al. | 219/229 |
| 5,247,158 | A | * | 9/1993 | Steinhauser et al. | 219/544 |
| 5,406,053 | A | | 4/1995 | Masreliez | 219/241 |
| 5,451,288 | A | * | 9/1995 | Smith et al. | 83/171 |
| 6,054,678 | A | * | 4/2000 | Miyazaki | 219/237 |

FOREIGN PATENT DOCUMENTS

| | | | |
|---|---|---|---|
| DE | 3024828 | * | 1/1982 |
| JP | 3-81029 | * | 4/1991 |
| JP | 8-330058 | * | 12/1996 |

* cited by examiner

*Primary Examiner*—John A. Jeffery

(57) ABSTRACT

A heating device comprises an thermally conductive tubular body with a thermally conductive end closure disposed at an axial end of the tubular body, an electrical resistance heating coil disposed in the tubular body and having an end spaced axially from the end closure, and a thermocouple disposed between the end of the heating element and the end closure. An outer tubular casing is disposed about the tubular body with an outer end cap disposed at an axial end of the tubular casing in contact with the end closure to receive heat therefrom by thermal conduction.

19 Claims, 5 Drawing Sheets

HEATING DEVICE WITH ELECTRIC HEATING ELEMENT AND THERMOCOUPLE

This application is a continuation-in-part of copending Ser. No. 09/689,405 filed Oct. 12, 2000.

FIELD OF THE INVENTION

The present invention relates to a heating device and a heated tool useful for working thermoplastic material.

BACKGROUND OF THE INVENTION

Many consumer products now are marketed and packaged in thermoplastic film or bag packaging. Such product packaging oftentimes includes one or more holes for different purposes. For example, a hole can be formed in thermoplastic film shrink fit packaging to permit venting of air during subsequent sealing of the packaging. U.S. Pat. No. 5,140,133 describes a hot hole punch for this purpose where a heating element directly contacts and melts a tear-resistant hole in the thermoplastic film.

Also, thermoplastic bag packaging may include one or more holes in a sealed bag flange region by which the package is hung on a rack for display to purchasers. The hole(s) is/are adapted to receive a rod(s) of the display rack to hang the bag on the rack.

An object of the present invention is to provide a heating device constructed to provide distribution of heat to an axial end thereof.

Another object of the present invention is to provide a heated tool constructed to provide distribution of heat to an axial end of the tool to form a hole in or otherwise work a thermoplastic material when the end of the tool and the material are brought into contact.

SUMMARY OF THE INVENTION

The present invention provides a heating device to provide thermal energy and to a heated tool for working a thermoplastic material such as making hole in the material, heat staking the material or other working of the material. The heating device comprises a thermally conductive tubular body with a thermally conductive end closure disposed at an axial end of the tubular body, an electrical resistance heating element disposed in the tubular body and having an end spaced axially from the end closure, and a thermocouple disposed between the end of the heating element and the thermally conductive end closure. An outer protective tubular casing is disposed about the tubular body with an outer protective end cap disposed at an axial end of the tubular casing in contact with the thermally conductive end closure to receive heat therefrom by thermal conduction.

The heating element typically comprises an electrical resistance heating coil having a pair of thermocouple wires that extend through the heating coil. An electrical insulator typically is disposed between the thermocouple and the end of the heating coil. An electrical insulator also typically is disposed between the heating element and the tubular body. A heat reflective thermal insulator is disposed between the tubular body and the outer protective tubular casing.

In one embodiment of the invention, the end closure comprises a copper plug disposed in an open axial end of a copper tubular body. The outer protective end cap is metallurgically attached to protective tubular casing and includes a recess or concavity that is with a thermally conductive material, such as braze material. The material is shaped to form a flat axial working tip or end of a heated tool.

In one embodiment of the invention, the outer end cap and the end closure include a threaded bore in which a threaded shaft of hole punch is threaded.

In another embodiment of the invention, the tubular casing includes a threaded outer periphery or circumference at its axial end, and an internally threaded hole punch is threaded on the threaded periphery.

A machine for hole punching, heat staking or other material working can include a tool support member and at least one heated tool of the type described above disposed on the tool support member in a manner that the hot tool end or tip can be brought into contact with the thermoplastic material.

The objects and advantages of the present invention will become more readily apparent from the following description taken with the following drawings.

DETAILED DESCRIPTION OF THE INVENTION

Figures 1, 2:
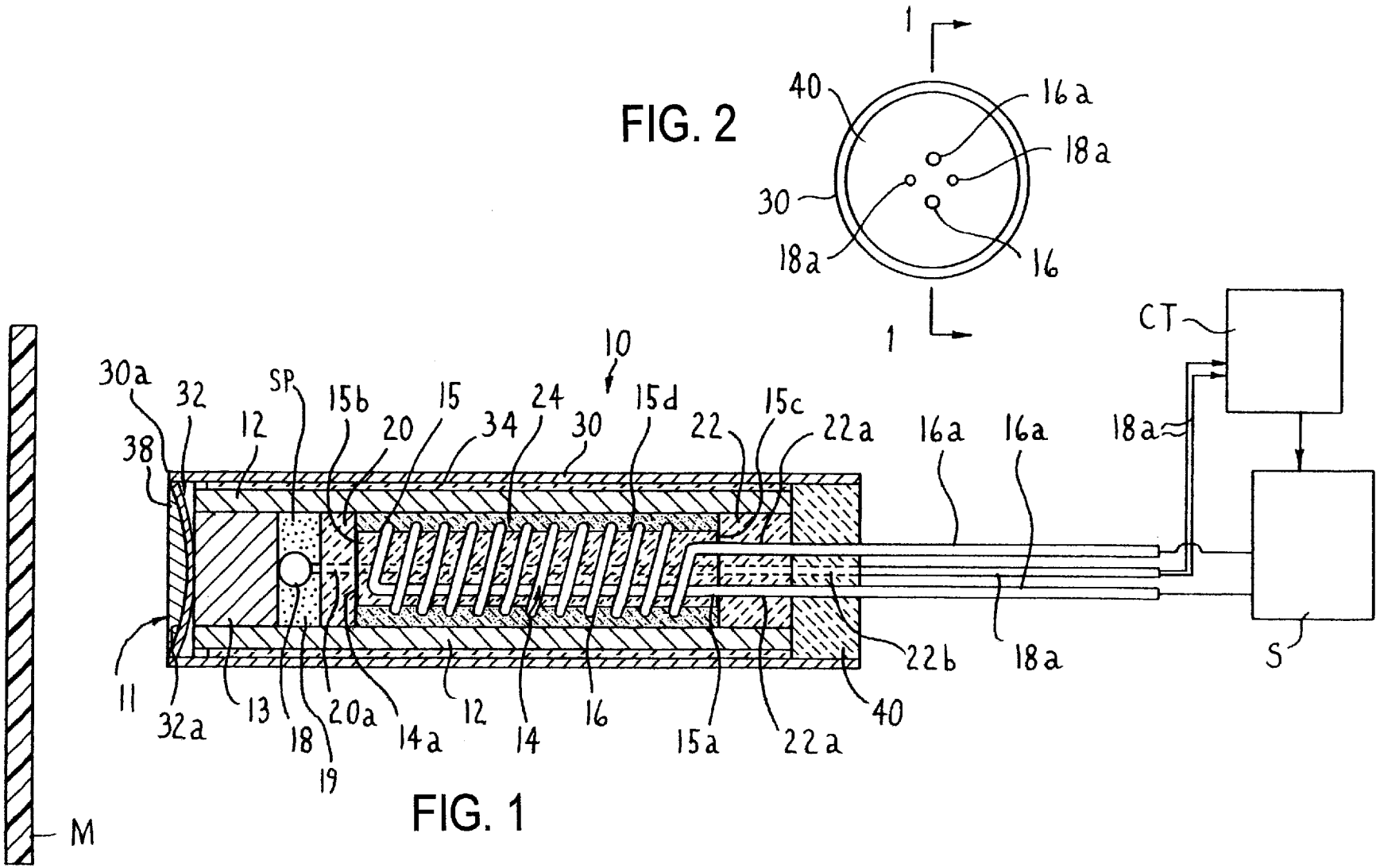
FIG. 1 is a longitudinal sectional view of a heating device, such as a heated tool, taken along 1—1 of FIG. 2, in accordance with one embodiment of the invention. The heating device is shown before a swaging or compression operation.
FIG. 2 is an end elevation of the tool of FIG. 1.

Referring to FIG. 1, a heating device 10 in accordance with an illustrative embodiment of the invention is shown. Although the heating device 10 is described for purposes of illustration and not limitation for use with respect to making a hole in thermoplastic sheet material M, the heating device 10 can be used to provide thermal energy in a variety of applications. For example, the heating device can be used as a heated tool to punch or form a hole in thermoplastic material, to heat stake thermoplastic material, otherwise in the working of thermoplastic material, or otherwise as a heat source.

The heating device 10 includes a thermally conductive tubular body 12 having a thermally conductive end closure 13 disposed at an axial open end 12*a* of the tubular body. The tubular body 12 and end closure 13 preferably are made of copper, such as oxygen-free type 102 copper, although other thermally conductive metals or metal alloys can be used. For purposes of illustration and not limitation, the tubular body 12 can comprise a cylindrical tube having an initial pre-swaged or pre-compressed inner and outer diameter of 0.256 inch and 0.350 inch, respectively, and an axial length selected for a particular hole punching application. The end closure 13 can comprise a separate cylindrical solid plug having an outer diameter (e.g. 0.256 inch prior to swaging or compression described below) to be press fit in the end 30*a* of the tubular body 12 and axial length selected for a particular hole punching application.

In an alternative embodiment of the invention, the end closure 13 can be integral with the tubular body 12. For example, the tubular body 12 with end closure 13 can be machined from a single piece cylindrical rod of copper or other heat conductive material.

An elongated electrical resistance heating element 14 is disposed on a cylindrical ceramic coil support rod 15 in the bore of tubular body 12. The heating element 14 is shown as a spiral heating coil 16 wrapped on the exterior surface of the ceramic rod 15. The heating coil 16 receives electrical power from a conventional power source S via a pair of lead wires 16*a* connected to the source S and to the coil 16. One of the lead wires 16*a* extends through an axial passage 15*a* in the rod 15 and is connected to the coil 16 proximate end 15*b* of the rod 15, while the other wire 16*a* is connected to the coil 16 proximate the end 15*c* of the rod. For purposes of illustration and not limitation, the coil 16 can comprise conventional 80/20 Ni/Cr alloy electrical resistance wire (diameter in the range of 0.04 to 0.36 millimeters for example only) wound on an MgO rod precompressed by extrusion by the rod manufacturer. For example only, the coil wire is wound on the MgO rod 15 having an outer rod diameter of 0.165 inch (for the tubular body 12 having the dimensions set forth above) prior to tool swaging or compression described below with the length of the rod 15 selected appropriate for a particular hole punching application.

As illustrated in FIG. 1, the heating element 14 includes an axial end 14*a* spaced axially from the end closure 13. A thermocouple 18 is disposed in a space SP between the axial end 14*a* of the heating element 14 and the end closure 13. The thermocouple 18 contacts the end closure 13 to provide an electrically grounded thermocouple. Alternately, the thermocouple 18 can be out of contact with and spaced axially from the closure 13 to provide an electrically ungrounded thermocouple. The thermocouple 18 includes a pair of thermocouple lead wires 18*a* that each extend through axial passages 15*d* (one shown) in the ceramic rod 15. The thermocouple 18 can comprise a conventional Type J or Type K thermocouple. The thermocouple senses the temperature of the end closure 13 and sends a signal to a conventional heating element controller CT to vary electrical power from a conventional power source S to the heating element 14 to control and maintain a desired tool tip temperature. The space SP typically is filled with MgO powder 19 of 80 to 200 mesh size (standard US sieve size).

A cylindrical electrical insulator disc 20 is disposed at the axial end 14*a* of the heating element 14 between the axial end 14*a* and the thermocouple 18. A similar cylindrical insulator disc 22 is disposed at the opposite inner axial end of the heating element 14 at the open end of the tubular body 12. The disc 20 includes a pair of axial passages 20*a* (one shown) to receive the thermocouple wires 18*a*. The disc 22 includes axial passages 22*a* to receive the coil lead wires 16*a* and axial passages 22*b* (one shown) to receive the thermocouple wires 18*a*. The discs 20, 22 can comprise extruded MgO discs having an outer diameter to fit snuggly in the tubular body 12 and an axial length selected for a particular hole punching application.

An electrical insulator material 24 is disposed in the annular space between the heating element 14 and the tubular body 12 and between the discs 20, 22 to thereby enclose the heating element 14. For purposes of illustration and not limitation, the insulator material 24 can comprise MgO powder (80 to 200 mesh size) filling the space, although other insulator materials can be used in practice of the invention. A barrier sleeve (not shown) or a barrier coating on the inner surface of tubular body 12 may be provided to provide a barrier between the material 24 and the tubular body 12 extending from end closure 13 to disc 22 to prevent reaction between the material 24 and body 12. The barrier sleeve or coating can comprise stainless steel to this end.

An outer protective tubular casing 30 is disposed about the tubular body 12 with an outer protective end cap 32 disposed at an axial end 30*a* of the tubular casing 30 overlying and in contact with the end closure 13 to receive heat therefrom by thermal conduction. The casing 30 is spaced radially from the tubular body 12 by a gap of 0.027 inch for purposes of illustration only. A heat reflective thermal insulator material 34 is disposed in the gap between the tubular body 12 and outer tubular casing 30 to reflect heat toward the tubular body 12. The material 34 can comprise alumina based high purity refractory fiber tape available as Ultra Temp 390 fiber tape material from Cotronics Corp., 3379 Shore Parkway, Brooklyn, N.Y. The fiber tape material 34 is infiltrated with MgO powder of 80 to 200 mesh prior to attachment of cap 32 to the casing 30. The protective casing 30 and end cap 32 can comprise a Type 321 stainless steel tube and disc, respectively, or any other suitable corrosion resistant material. The casing 30 and end cap 32 made of Type 321 stainless steel can have a thickness of 0.5 millimeter and 0.5 millimeter, respectively, for purposes of illustration only.

Figure 3:
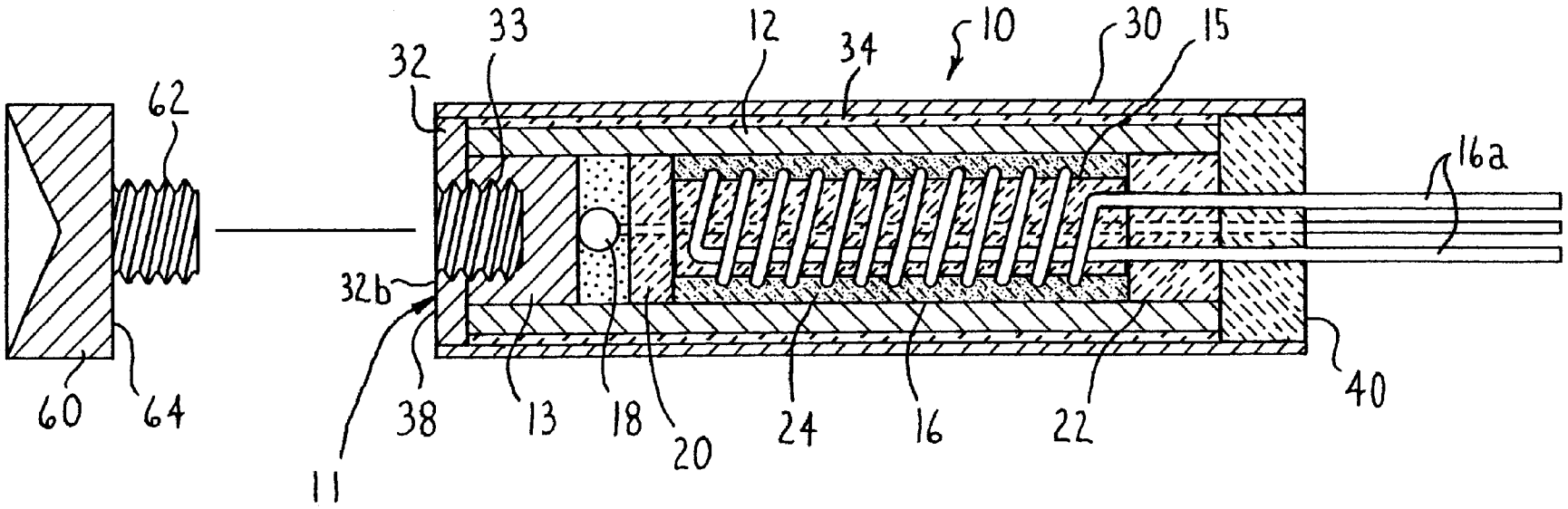
FIG. 3 is a longitudinal sectional view of a heating device in accordance with another embodiment of the invention.

The outer end cap 32 is metallurgically attached to the casing 30. For example, the circumferential periphery is welded by TIG (tungsten inert gas) welding in the open end 30*a* of the casing 30. The end cap 32 includes a recess or concavity 32*a* to provide intimate thermal contact with end closure 13. The recess or concavity 32*a* is filled with a thermally conductive material 38, such as silver braze material, melted and solidified therein. A suitable silver braze is available as silverbraze 45, #1005, from Fontargen GmbH, Siemensstrasse 4, Eisenberg/Pfalz, Germany, although the invention is not limited to this braze material as other thermally conductive materials may be used as the filler material. The filler material then is shaped by, for example, milling or other machining operation, to form a flat axial tip or end 11 of the heating tool 10. Alternately, the end cap 32 can be flat without a concavity 32*a* so that the filler material 38 may be omitted. Alternately, as illustrated in FIG. 3, a copper or other thermally conductive end cap 32 can be welded or otherwise attached in the open end 30*a* of tubular casing 30 and have a flat axial end 32*b* to form the working tool end 11 to avoid the need to fill concavity 32*a* with thermally conductive material 38.

The opposite end of the casing 30 is sealed with a ceramic seal material such as a liquid potted ceramic that is curable to a hardened state to form a permanent ceramic seal 40 about the power lead wires 16*a* and thermocouple wires 18*a*. A suitable ceramic seal material is available from Sauereisen Cement, 160 Gamma Drive, RIDC Industrial Park, Pittsburgh, Pa. 15238.

In assembly of the above heater components, the electrical insulator material 24 is introduced about the heating element 16 residing in the tubular body 12 with disc 22 in place in the tubular body. The tubular body 12 is held in a vertical position so that the material 24 can be sprinkled between the heating element 16 and the tubular body 12. The disc 20 then is positioned in the tubular body 12. The MgO powder 19 then is placed in the space SP about the thermocouple 18 followed by end closure 13. After the thermal insulator material 34 is placed about the tubular body 12 followed by placement of the casing 30 thereabout, the assembly is held in a vertical or near vertical position so that the MgO powder can be placed in the open top of the assembly, which is vibrated to infiltrate the MgO powder into the thermal insulator material 34 along its length. The end closure 13 then is inserted and welded in place in the tubular casing 30.

Figure 1A:
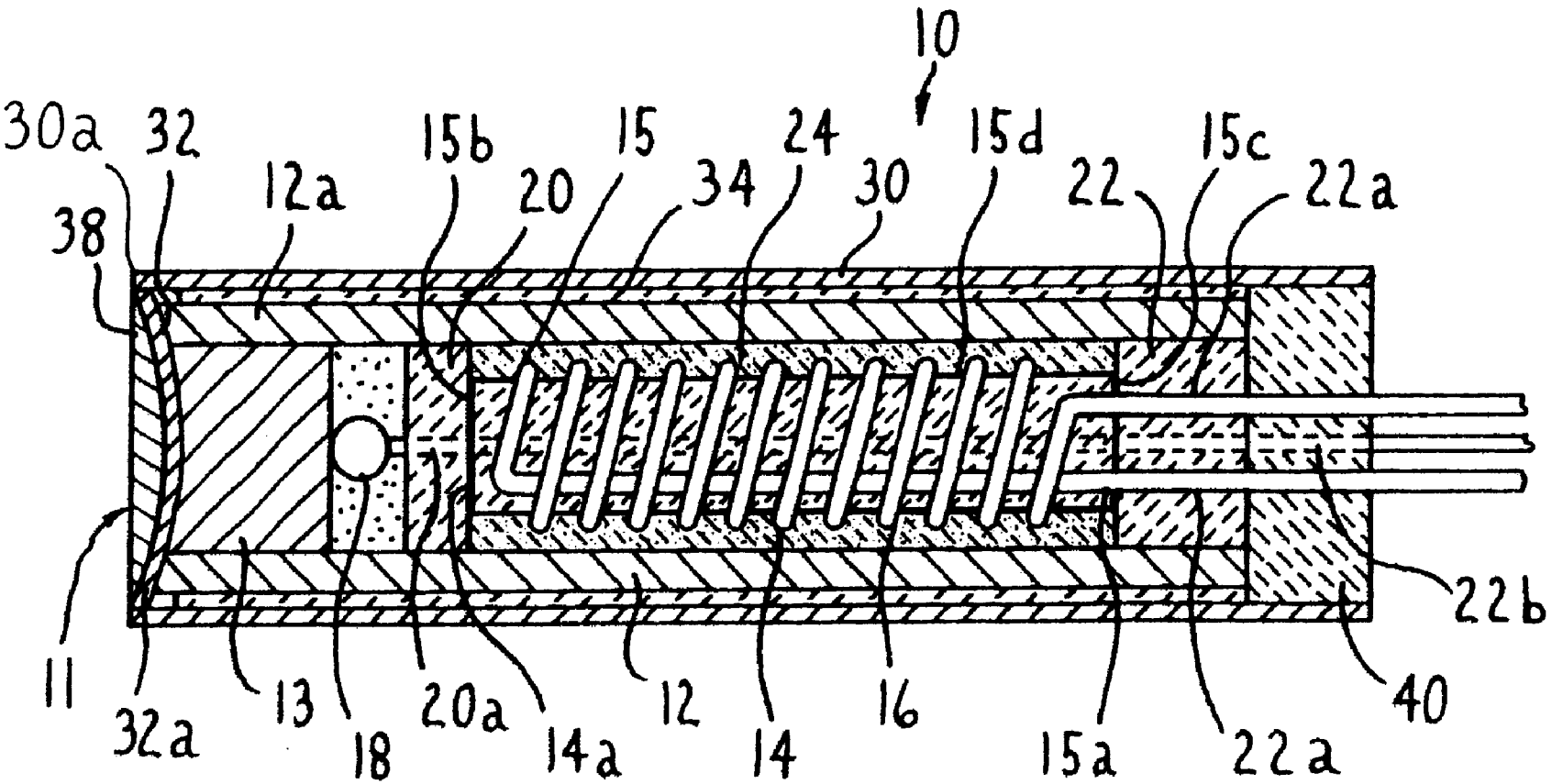
FIG. 1A is a longitudinal sectional view of the heating device after a swaging or compression operation.

After assembly of the above components in this manner, the heating device 10 is sized and radially compressed by a conventional swaging or compression operation such as a swaging operation using multiple swaging dies, a tube rolling operation using multiple tube rollers, or any other technique to apply radial compression force on the tubular casing 30 to compress the assembled heating device 10 radially to desired size and to force air out of the interior of the tool. The swaging or compression operation elongates some of the device components (e.g. copper tubular body 12, end closure 13, rod 15 and heating element 14) in an axial direction to provide enhanced contact between the end cap 32 and tubular body 12/end closure 13 as illustrated in FIG. 1A. The swaged or compressed heating device 10 is heated in an oven at or above 200 degrees F. (e.g. 200 degrees F. for 15 minutes or more) to dry the tool and remove internal moisture therefrom. The ceramic seal 40 then is formed about the power lead wires and thermocouple lead wires. The outer diameter of the swaged or compressed heating device 10 can be selected as desired for an intended hole punching application such as, for example only, ¼, ⅜, ½, ¾ and 1 inch outer tool diameter. The outer diameter of the swaged or compressed heating device 10 optionally can be ground to final dimension by, for example, centerless grinding.

The heating device 10 can be used for providing thermal energy in a variety of applications including, but not limited to, applying heat locally to a region of material or a body such as a mold, tool, and other members, hole punching, heat staking, and other working of thermoplastic material. When the heating device is used to form a hole in thermoplastic material M, the hot tip or end 11 of the heating device 10 and the material M are directly contacted. The thermally conductive body 12 and end closure 13 conduct heat generated by the heating element 14 to the end closure 13 to heat the tip or end 11 to a high enough temperature to melt and form a hole in the thermoplastic sheet material M.

In another embodiment of the invention illustrated in FIG. 3 where like heater features are represented by like reference numerals, the end 11 of the heating device 10 is adapted to be connected to a hole punch tool 60 that may be custom designed for each customer and hole punching application. In particular, the outer end cap 32 and the end closure 13 include a threaded bore 33 in which a threaded shank 62 of the hole punch tool 60 is threaded and attached to the tool end 11 with the end surface 64 of the punch 60 in thermal conducting contact with end 11.

Figure 4:
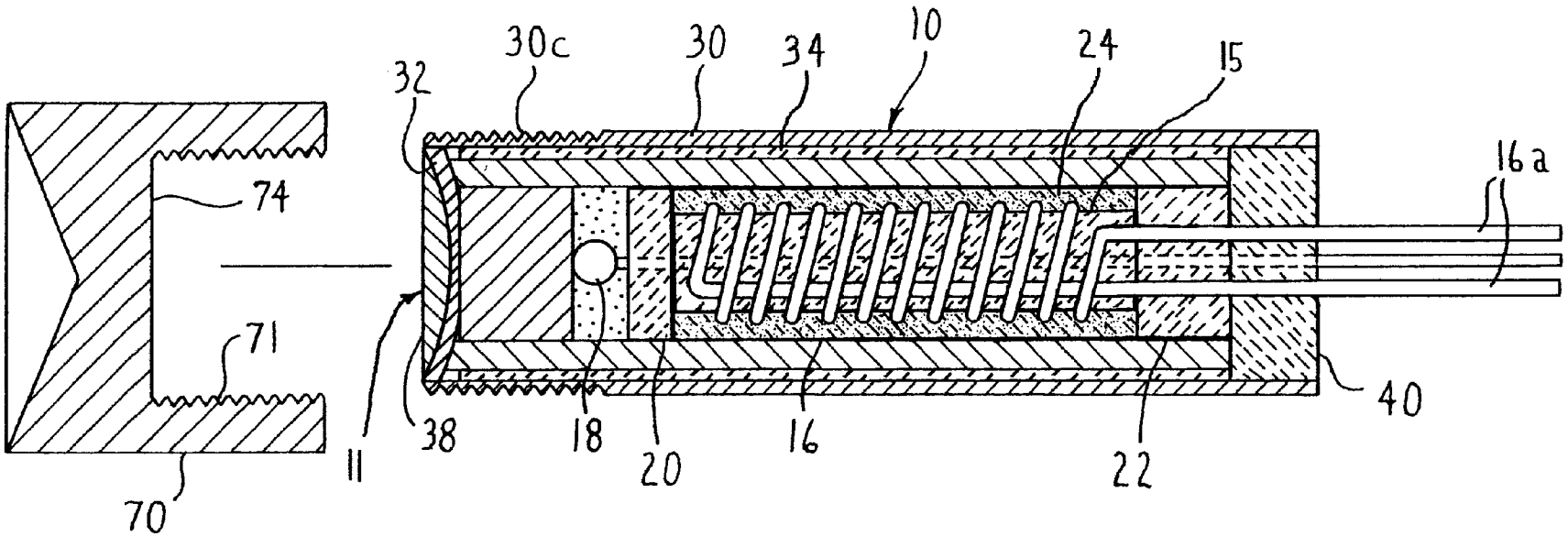
FIG. 4 is a longitudinal sectional view of a heating device in accordance with still another embodiment of the invention.

In another embodiment of the invention shown in FIG. 4 where like heater features are represented by like reference numerals, the end 11 of the heating device 10 is adapted to be connected to a hole punch tool 70 that may be custom designed for each customer and hole punching application. In particular, the tubular casing 30 includes a threaded end periphery or circumference 30*c* at its axial end. Hole punch tool 70 includes a threaded counterbore 71 that is threaded on the threaded periphery or periphery 30*c* of the casing 30 to attach the punch tool 70 to the end 11 with the end surface 74 of the punch tool 70 in thermal conducting contact with tool end 11.

Figure 5:
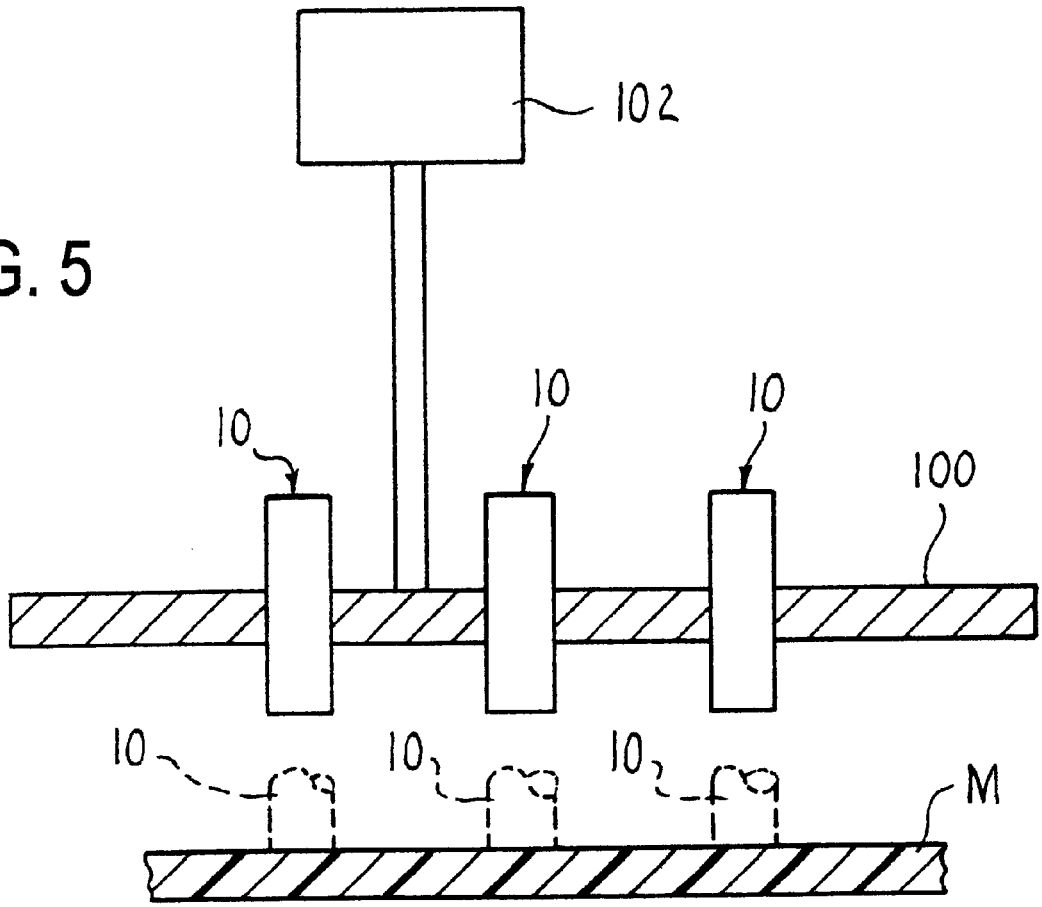
FIG. 5 is a schematic view of a hole punching machine including a heated tool of the invention.

As shown in FIG. 5, the heating device 10 can be used as a tool in a hole punching machine that includes a tool support member 100 and one or more heating devices 10 of FIGS. 1, 3 and 4 as tools disposed on the support member 100. The tool(s) are disposed on the support member 100 that is moved by a fluid cylinder 102 or other moving device to contact the heated end 11 of FIG. 1, punch 60 of FIG. 3, or punch 70 of FIG. 4, with a thermoplastic sheet material M to melt a hole in the material. The heating device 10 of the invention is advantageous in that the end 11, punch 60 or punch 70, is heated by thermal conduction through the tool components as described above without the need to heat the tool support member 100, which can be unheated.

Although the invention has been described with respect to certain illustrative embodiments, those skilled in the art will appreciate that the invention is not so limited and can be changed, adapted and the like within the scope of the following claims.

What is claimed is:

1. A heating device, comprising a thermally conductive tubular body having a thermally conductive end closure disposed at an axial end thereof, an electrical resistance heating element disposed in said tubular body and having an end spaced axially from said end closure, a thermocouple disposed between said end of said heating element and said end closure, an outer tubular casing disposed about said tubular body, and an outer end cap disposed at an axial end of said tubular casing in contact with said end closure.

2. The device of claim 1 including an electrical insulator disposed between said end of said heating element and said thermocouple.

3. The device of claim 2 including an electrical insulator material between said heating element and said tubular body.

4. The device of claim 1 wherein said end closure comprises a thermally conductive plug disposed in an open axial end of said tubular body.

5. The device of claim 4 wherein said plug and said tubular body each comprises a thermally conductive material.

6. The device of claim 1 including a thermal insulator material disposed between said tubular body and said tubular casing.

7. The device of claim 1 wherein said outer end cap includes an outer flat axial end.

8. The device of claim 1 wherein said outer end cap is metallurgically attached to said tubular casing.

9. The device of claim 1 wherein said outer end cap includes an outer axial end having a concavity.

10. The device of claim 9 wherein said concavity is filled with a thermally conductive material solidified in said concavity.

11. The device of claim 10 wherein said material is shaped to form an outer flat axial end thereof.

12. The device of claim 11 wherein said thermocouple includes a pair of wires that extend through the heating coil.

13. The device of claim 1 wherein said heating element comprises an electrical resistance heating coil.

14. The device of claim 1 wherein said end closure includes a threaded bore.

15. The device of claim 14 including a tool threaded in said bore.

16. The device of claim 1 wherein said tubular casing includes a threaded periphery at its axial end.

17. The device of claim 16 including a tool threaded on said threaded periphery.

18. A tool, comprising a thermally conductive tubular body having a thermally conductive end closure disposed at an axial end thereof, an electrical resistance heating element disposed in said tubular body and having an end spaced axially from said end closure, a thermocouple disposed between said end of said heating element and said end closure, an outer tubular casing disposed about said tubular body, and an outer end cap disposed at an axial end of said tubular casing in contact with said end closure.

19. A hole punching machine including a tool support member and at least one tool of claim 18 disposed on said support member, and means for moving said support member to contact said tool with a thermoplastic material.

* * * * *